US008042851B2

(12) United States Patent
Lai Martinez

(10) Patent No.: US 8,042,851 B2
(45) Date of Patent: Oct. 25, 2011

(54) CHOPSTICKS

(76) Inventor: Mario Lai Martinez, Barcelona (ES)

( * ) Notice: Subject to any disclaimer, the term of this patent is extended or adjusted under 35 U.S.C. 154(b) by 313 days.

(21) Appl. No.: 12/522,979

(22) PCT Filed: Mar. 2, 2007

(86) PCT No.: PCT/ES2007/000114

§ 371 (c)(1),
(2), (4) Date: Jul. 13, 2009

(87) PCT Pub. No.: WO2008/087229

PCT Pub. Date: Jul. 24, 2008

(65) Prior Publication Data

US 2010/0013254 A1 Jan. 21, 2010

(30) Foreign Application Priority Data

Jan. 18, 2007 (ES) ..... 200700105

(51) Int. Cl.
*A47G 21/10* (2006.01)

(52) U.S. Cl. ..... 294/99.2; 294/218

(58) Field of Classification Search ..... 294/99.2, 294/1.1, 218

See application file for complete search history.

(56) References Cited

U.S. PATENT DOCUMENTS

| | | | | |
|---|---|---|---|---|
| 1,260,302 A | | 3/1918 | Barrows | |
| D188,125 S | * | 6/1960 | Zinn | D7/687 |
| 4,973,095 A | | 11/1990 | Kunihis | |
| 6,581,997 B1 | * | 6/2003 | Martikainen et al. | 294/99.2 |

FOREIGN PATENT DOCUMENTS

| | | | |
|---|---|---|---|
| DE | 8706456 | | 11/1987 |
| EP | 1152677 | | 12/2003 |
| JP | 6022837 | | 2/1994 |
| JP | 10337239 | | 12/1998 |
| JP | 2000342421 | | 12/2000 |
| JP | 2000342421 A | * | 12/2000 |
| WO | 9741762 | | 11/1997 |
| WO | 0042889 | | 7/2000 |

* cited by examiner

*Primary Examiner* — Saul Rodriguez
*Assistant Examiner* — Gabriela Puig
(74) *Attorney, Agent, or Firm* — Sturm & Fix LLP

(57) ABSTRACT

Chopsticks, used for eating, of the type that have a notch, to enable them to be coupled together, arranged in an oblique position on one of the surfaces close to the upper end of the chopsticks, with a suitable slope for assembling the chopsticks in the manner of pliers, with a depth equivalent to half the thickness of the chopstick and with a width equivalent to the width of the actual chopstick, provision having been made for each of the upper edges of said notch to end in ribs that emerge towards the inside of the notch in order for one chopstick to be snap-fitted together with the other.

3 Claims, 2 Drawing Sheets

CHOPSTICKS

OBJECT OF THE INVENTION

The present invention relates to chopsticks of the type used for eating, which are handled by the diner like pliers so as to grab the pieces of food from the plate and lift them to the mouth.

The chopsticks of this invention have been specially thought out to make their use easier by diners not used to using them, thanks to the arrangement of a special notch that allows them to be coupled together so as to be used like pliers.

BACKGROUND OF THE INVENTION

The traditional Chopsticks are made from two simple rectilinear sticks that are difficult to handle by unskilled diners as a certain skill is necessary for its use.

In order to make the handling of the Chopsticks easier the European patent EP 1152677 is known in the state of the art, describing chopsticks fitted with a notch so as to fit together and with a longitudinal cleft that extends from the lower section of said notch, where the free portion acts by way of a spring so as to use the chopsticks like pliers.

The solution described in said patent has the disadvantage that to keep the chopsticks held together like pliers it is necessary to apply pressure by the thumb and index finger; this is a nuisance as the hand is always busy. Another disadvantage is that of having to have the chopstick constantly under pressure so as to use them, accidentally they can slip from between the fingers and fly off. Finally, the existence of a longitudinal cleft is another disadvantage as waste food can build up in it.

DESCRIPTION OF THE INVENTION

The Chopsticks proposed by the invention resolves the previously described problems, on having a notch arranged in an oblique position on one of the surfaces close to the upper end of the chopsticks with an incline suitable for assembling the chopsticks like pliers, with a depth equivalent to half the thickness of the chopstick and with a width equivalent to the width of the actual chopstick.

In order to fit the chopsticks to each other using said notch and so that they are snap-fitted together, the upper edges of said notch end in ribs that emerge towards the inside of the notch. Said narrowing of the upper part of the notch prevents them from coming apart during use.

The chopsticks of the invention can be used both like pliers thanks to these special notches or equally in a traditional manner. In order to do this the chopsticks have a lateral tab next to the oblique notch with dimensions that coincide with the hollow in the notch, made so as to join and fit into said notch, the chopsticks finishing up completely rectilinear.

As the chopsticks that make up the pair are identical in the make up they can be made from a single mould.

Likewise, both the chopstick and the tab are made from a single piece of plastic material.

DESCRIPTION OF THE DRAWINGS

In order to complete the description that is being made and for the purpose of helping to give a better understanding of the characteristics of the invention, according to a preferred example of a practical embodiment thereof, said description is accompanied by a set of drawings as an integral part in which the following has been represented by way of illustration but without being by way of limitation.

PREFERRED EMBODIMENT OF THE INVENTION

Figure 1:
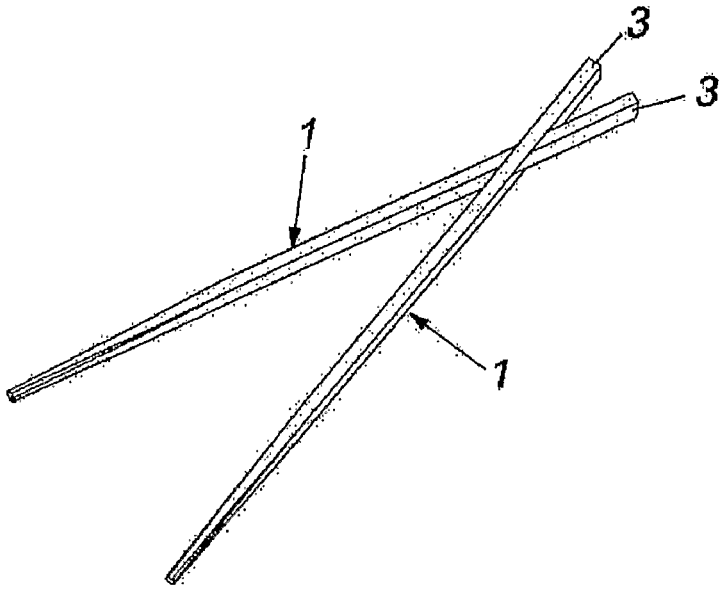
FIG. 1 shows a perspective view of the chopsticks assembled together like pliers about to be used.
Figure 2:
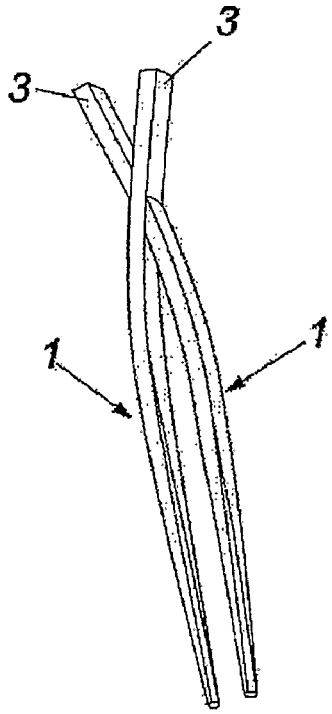
FIG. 2 shows another perspective view of the chopsticks assembled with the lower ends bent.
Figure 3:
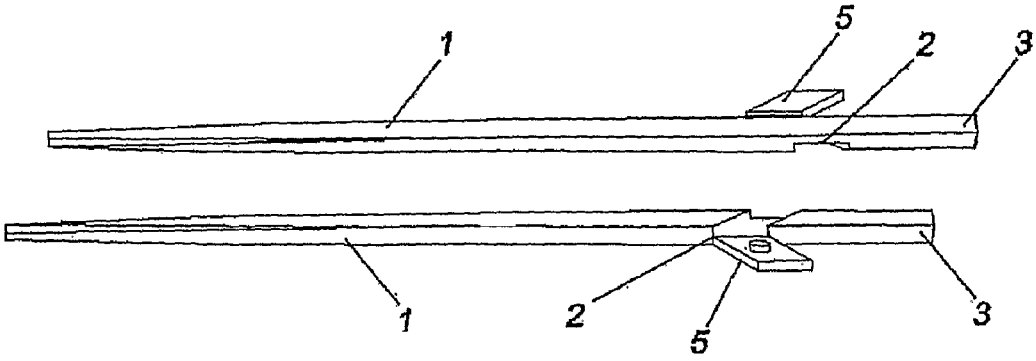
FIG. 3 shows a perspective view of the chopsticks separated.
Figure 4:
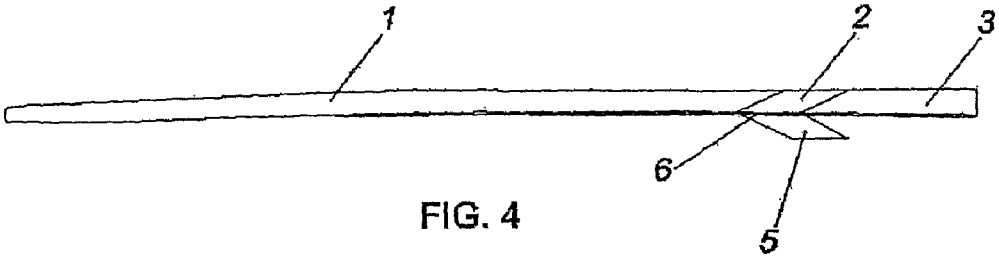
FIG. 4 shows a plan view of one of the chopsticks.
Figure 5:
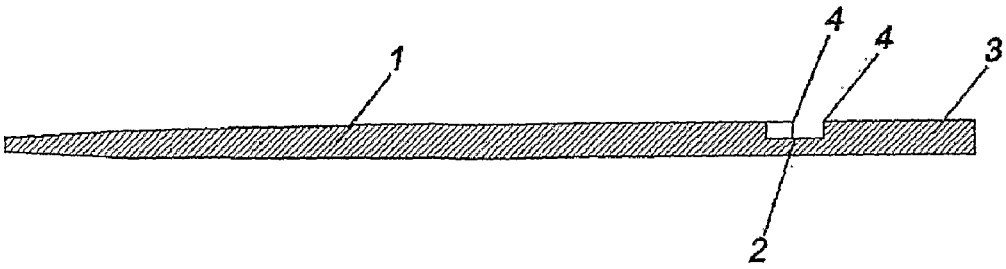
FIG. 5 shows a longitudinal section of the chopstick in which the ribs of the notch can be seen.

In view of the figures described, it can be seen how the Chopsticks 1 are provided with a notch 2 arranged in an oblique position on one of the surfaces close to the upper end 3 of the chopsticks, with a suitable slope for assembling the chopsticks in the manner of pliers, as and how can be seen in FIGS. 1 and 2.

The depth of said notch 2 is equivalent to half the thickness of the chopstick, and the width equivalent to the width of the actual chopstick, in such a way that the chopsticks join together perfectly and are fitted by means of said notches, in the manner of pliers. The slope of said notches 2 is suitable so that the separation of the lower ends of the chopsticks can be circled by the thumb and the index finger.

Thanks to the flexible nature of the material that the chopsticks are made from, it is possible to bend the lower ends of the chopsticks so as to bring them closer together, thus trapping a portion of food so as to lift it to the mouth.

So as to prevent the chopsticks from coming apart during use, the upper edges of said notch 2 are finished off with ribs 4 that emerge towards the inside of the notch 2, in order for one chopstick to be snap-fitted together with the other.

Likewise the chopsticks have a lateral tab 5 next to the oblique notch 2 with dimensions that coincide with the hollow in the notch, made so as to join and fit into said notch, the chopsticks finishing up completely rectilinear, for the circumstances in which it is desired to use them in a traditional manner.

The lateral tab 5 is equally thought out so as to assemble one chopstick onto another in a parallel manner, fitting onto the notch of the other chopstick, for storage, distribution and presentation. In this way pairs of chopsticks are supplied joined together in parallel by means of said tabs 5 and notches 2. At the point of their use, the diner must separate the chopsticks, breaking the join 6 between the lateral tab 5 and the chopstick 1. Said link 6 is the connection point of the material itself from which the chopstick 1 is manufactured and the very weak tab (5 so as to make its breakage and separation easy.

As the chopsticks 1 that make up the pair are identical in their make up they can be made from a single mould.

Likewise, both the chopstick 1 and the tab 5 are made from a single piece of plastic material.

Having sufficiently described the nature of the invention, likewise the manner of carrying it out in practice, it must be placed on record that the afore stated and represented provisions in the attached drawings can be modified in so far as they do not alter the basic principle.

The invention claimed is:

1. Apparatus comprising: A pair of chopsticks, used for eating, each having a notch to enable them to be coupled together, said notch being arranged in an oblique position on one of the surfaces close to the upper end of the chopsticks with a suitable slope for assembling the chopsticks in the manner of pliers, with a depth equivalent to half the thickness of one of the chopsticks and with a width equivalent to the width of said one of the actual chopsticks, provision having been made for each of the upper edges of said notch to end in ribs that emerge towards the inside of the notch in order for said one chopstick to be snap-fitted together with the other chopstick, and in which said chopsticks have a lateral tab next to the oblique notch with dimensions that coincide with a hollow of the notch, made so as to join and fit into said notch.

2. Chopsticks, according to claim 1 that make up the pair are identical.

3. Chopsticks, according to claim 1 and the lateral tab is made from a single piece of plastic material.

* * * * *